United States Patent [19]

McDowell

[11] Patent Number: 4,608,520

[45] Date of Patent: Aug. 26, 1986

[54] CATHODE DRIVEN CROSSED-FIELD AMPLIFIER

[75] Inventor: Hunter L. McDowell, Concord, Mass.

[73] Assignee: Varian Associates, Inc., Palo Alto, Calif.

[21] Appl. No.: 518,719

[22] Filed: Jul. 29, 1983

[51] Int. Cl.[4] ..... H01J 25/34

[52] U.S. Cl. ..... 315/39.3; 315/3.6

[58] Field of Search ..... 315/39.3, 3.6

[56] References Cited

U.S. PATENT DOCUMENTS

| | | | |
|---|---|---|---|
| 3,073,991 | 1/1963 | Osepchuk | 315/39.3 |
| 3,123,735 | 3/1964 | Hull | 315/39.3 |
| 3,253,230 | 5/1966 | Osepchuk | 315/39.3 |
| 3,619,709 | 11/1971 | Dudley et al. | 315/39.3 |
| 3,646,388 | 2/1972 | Dudley et al. | 315/39.3 |
| 4,087,718 | 5/1978 | Farney | 315/39.3 |

OTHER PUBLICATIONS

"Cathode-Driven, High Gain, Crossed-Field Amplifier," Raytheon Company report No. PT-4345, Apr. 1975.

J. R. M. Vaughan, "Computer Analysis of the Cathode-Driven Crossed-Field Amplifier," U.S. Army Electronics Command, Technical report ECOM-7-6-1359-F, May 1977, pp. 1-14.

*Primary Examiner*—Saxfield Chatmon

*Attorney, Agent, or Firm*—Stanley Z. Cole; Richard B. Nelson

[57] ABSTRACT

In a crossed-field amplifier tube, an input section of slow-wave circuit is part of the cathode electrode. An output section of slow-wave circuit is part of the anode electrode. The anode circuit is axially displaced from the cathode circuit in the direction of drift of the electron stream so that a non-propagating section of the anode faces at least a part of the propagating cathode circuit.

10 Claims, 3 Drawing Figures

CATHODE DRIVEN CROSSED-FIELD AMPLIFIER

FIELD OF THE INVENTION

The invention pertains to crossed-field amplifier tubes particularly tubes in which the input signal is applied to a slow-wave interaction circuit which is part of the cathode electrode.

PRIOR ART

In a crossed-field amplifier (CFA), a stream of electrons flows between an extended cathode surface and a generally parallel anode surface. At least a part of the anode is a wave propagating circuit with a wave velocity matched to the drift velocity of the electron stream in the crossed electric and magnetic fields. In a non-reentrant CFA, near the input end of the tube the electron stream is substantially confined to a thin layer near the cathode surface. An input wave on the anode circuit has small rf electric fields near the cathode, so the build-up of the trajectory modulation to produce electrons striking the cathode with energy to produce secondary emission multiplication is slow. Also the formation of charge spokes which induce waves in the output part of the circuit is delayed.

It has been proposed in the prior art to make the cathode a second slow-wave interaction circuit onto which the input signal would be applied. The rf fields of this circuit would be high near the cathode surface and would interact strongly with the nearby electron stream. Thus the build-up of current and wave energy could be much faster. The charge spokes built up by the input cathode circuit would then drive the output anode circuit. I have found that this prior-art scheme is often unsatisfactory. There is inevitable coupling between the facing anode and cathode circuits. Also, the terminations of the circuits at both their externally coupled input and output ends and at their internal wave-absorbing terminations are never perfect, so that some of their waves are reflected at the ends. Energy reflected from the output of the anode circuit can be coupled back to form a backward wave in the cathode circuit. This backward wave can be partially re-reflected at the input of the cathode circuit. The resulting forward wave is regenerative and can lead to instabilities. A second problem is that waves on the anode circuit set up fields near the cathode circuit which can interfere with the build up of space charge under control of the input circuit.

SUMMARY OF THE INVENTION

An object of the invention is to provide a CFA having high stable gain.

A further object is to provide a CFA having minimum length.

These objects are realized by providing a CFA with two slow-wave interaction circuits. One is part of the cathode, with interaction elements facing the electron stream and an input end coupled to the external input signal. The other is part of the anode with an output end coupled to the external output load. The other ends of the circuits are terminated in lossy loads. The anode circuit is displaced from the cathode circuit downstream in the direction of drift of the electron stream. Thus the harmful regenerative feed-back effects are greatly reduced.

DESCRIPTION OF THE PREFERRED EMBODIMENTS

Figure 1:
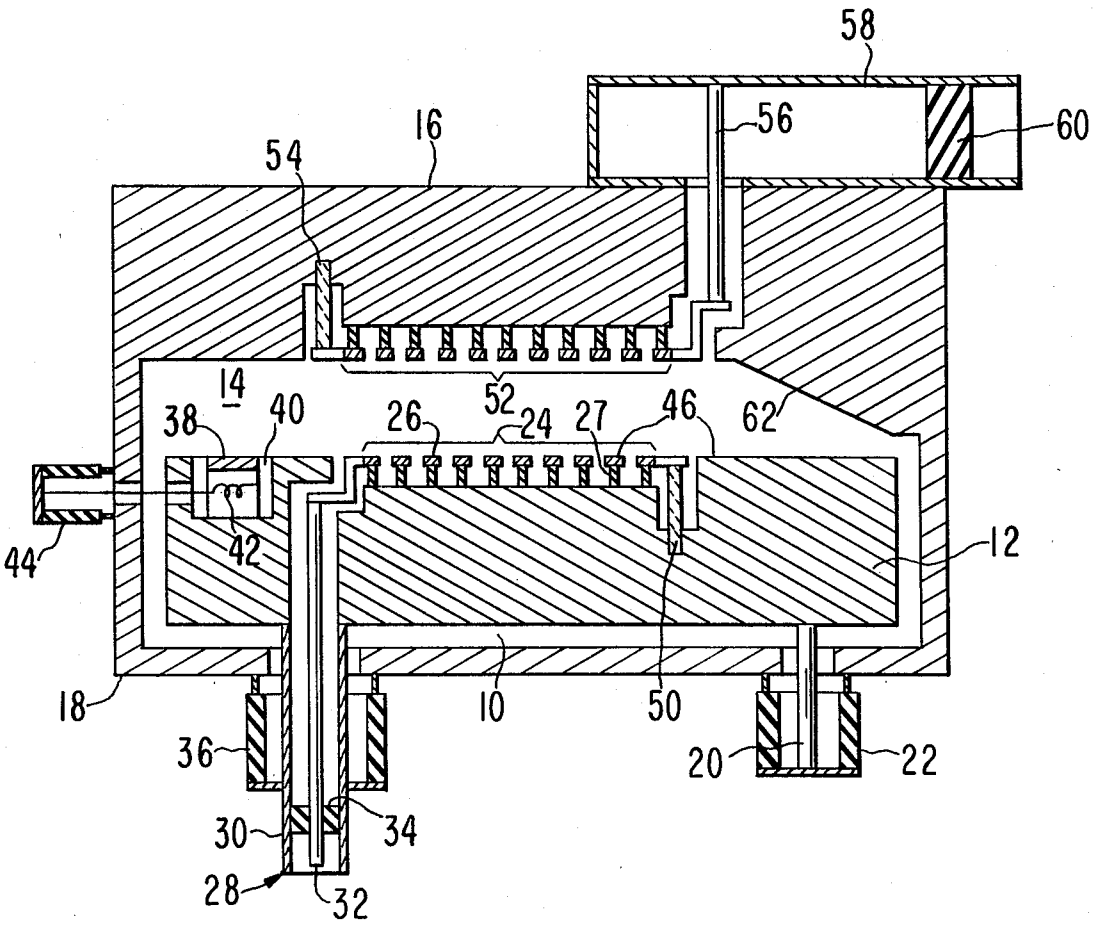
FIG. 1 is a schematic cross-section of a prior-art CFA.

FIG. 1 illustrates a prior-art CFA which comprises an input slow-wave circuit in the cathode and an output slow-wave circuit in the anode.

The cathode structure 10 comprises a metallic block 12 as of OFHC copper, extended in the direction of electron drift in the crossed D.C. electric and magnetic fields in the open space 14 between cathode structure 12 and a parallel opposed anode structure 16. Anode structure 16 is typically operated at ground potential and forms a part of the tube's vacuum envelope 18. Cathode structure 10 is operated at a negative potential such that electron are drawn from it toward anode structure 16. A magnetic field is applied perpendicular to the plane of FIG. 1 causing the electrons to drift toward the right in the well-known crossed-field interaction.

Cathode block 12 is supported by one or more rods 20 mounted through dielectric insulating cylinders 22 forming part of vacuum envelope 18. Rods 20 may be replaced by hollow tubes (not shown) for carrying a fluid to cool cathode block 12.

A portion 24 of cathode structure 10, embedded in cathode block 12, is constructed as a slow-wave circuit having a wave velocity comparable to the drift velocity of electrons in the crossed fields. In FIG. 1 slow-wave circuit 24 is a meander line formed by a meandering conductor 26 attached along its bottom side to cathode block 12 via ceramic supports 27. An input rf signal is coupled to the upstream end of slow wave circuit 24 through a coaxial transmission line 28. The outer conductor 30 of transmission line 28 is electrically integral with cathode block 12. The center conductor 32 passes inside outer conductor 30 and connects directly with the end of meandering conductor 26 to introduce the rf drive signal. Coaxial line 28 is vacuum-sealed by a transverse dielectric window 34 and is mounted on and insulated from vacuum envelope 18 by a high-voltage coaxial dielectric seal 36.

The initial electron stream for the amplifier comes from a thermionic cathode 38 mounted in a recess 40 in cathode block 12. It is heated by a radiant heater 42 which is supplied with heating current via an insulating vacuum seal 44. This electron current passes between the slow-wave circuits 24, 52 and is interacted on by the rf wave on the cathode circuit 24 in such a way as to produce rf electron bunching and selective bombardment of the cathode 10 by the electrons bunched in that phase of the rf wave wherein they gain energy from the rf wave. Through the process of secondary emission multiplication, the amount of bunched charge becomes greatly enhanced. The surface 46 of cathode structure 10 facing the electron stream may be coated with a material having high secondary emission to increase the available electron current. At the downstream end of slow-wave circuit 24 a block of lossy dielectric 50 absorbs any remaining wave energy in the circuit.

In the prior-art amplifier of FIG. 1 the high-level amplification and power extraction is provided by a second slow-wave interaction circuit 52 embedded in anode block 16. Output circuit 52 is similar to input circuit 24. Its input end is terminated by a second lossy dielectric block 54. The downstream, output end of circuit 52 is directly connected via a coaxial-to-waveguide transducer 56 to an output waveguide 58 sealed by a dielectric vacuum window 60. The output power is carried by waveguide 58 to the external useful load (not shown). Beyond the output end of slow-wave circuit 52 the surface 62 of anode block 16 facing cathode block 12 is tapered closer to cathode 12. This causes collection of the spent electron stream over an extended area to spread out the heat dissipation. Anode block 16 may be cooled by fluid coolant passages or external air fins (not shown).

The purpose of the prior-art arrangement of FIG. 1 is to provide a crossed-field amplifier with isolated input and output circuits and with high gain. In the original crossed-field amplifier, the cathode was a smooth surface. The anode contained the slow-wave circuit, connected to an input transmission line at one end and the output transmission line at the other. Near the input, where the rf signal was small, the electron stream is confined to a thin ribbon near the cathode by the transverse magnetic field. The small rf electric field from the slow-wave circuit is a fringing field from the main electric field between adjacent anode segments. It decays somewhat exponentially with distance from the anode tips and is practically short-circuited by the conductive smooth cathode. Thus the rf field interacting with the cathode-hugging electron stream is small and the build-up of field and stream modulation is slow and the build-up of charge through secondary emission multiplication is either slow, or for low power levels, altogether non-existent. This limits the available gain of the tube. The gain cannot be increased by merely lengthening the structure if the input power is insufficient to trigger the charge build-up.

In the amplifier of FIG. 1 with the input signal on a slow-wave circuit which is part of the cathode, the rf field of the circuit is much higher at the near-by electron stream, so the interaction in the input region is much stronger than in a smoothcathode tube. When the electron stream becomes highly modulated into "spokes" and loses some energy to the circuit, the "spokes" move close to the anode circuit and instigate the output power therein.

The amplifier of FIG. 1 has however proven to be unsatisfactory due to regenerative instability. One basic cause is that matches between slow-wave circuits and external transmission lines are always imperfect. Particularly if a wide frequency range is to be covered, there is some residual wave reflection at the junction. Also, mismatches to the external signal generator and load create reflections. A large reflected wave in the output circuit 52 can, by electromagnetic coupling, generate a small backward wave in input circuit 24. This may be partially reflected at the input end of circuit 24 to produce a regenerated forward wave. Thus the spurious signal can build up until oscillation is produced.

Another distorting process is interference by a large reverse directed wave on the anode circuit with the build-up of charge through the secondary emission multiplication process near the input. Such a large reverse directed wave can occur as a result of reflections of the output wave from the load. Although the reverse directed wave is non-synchronous with the forward directed electron flow at the input, its fields still exert a significant influence on the relatively short electron trajectories in the charge build-up region.

Figure 2:
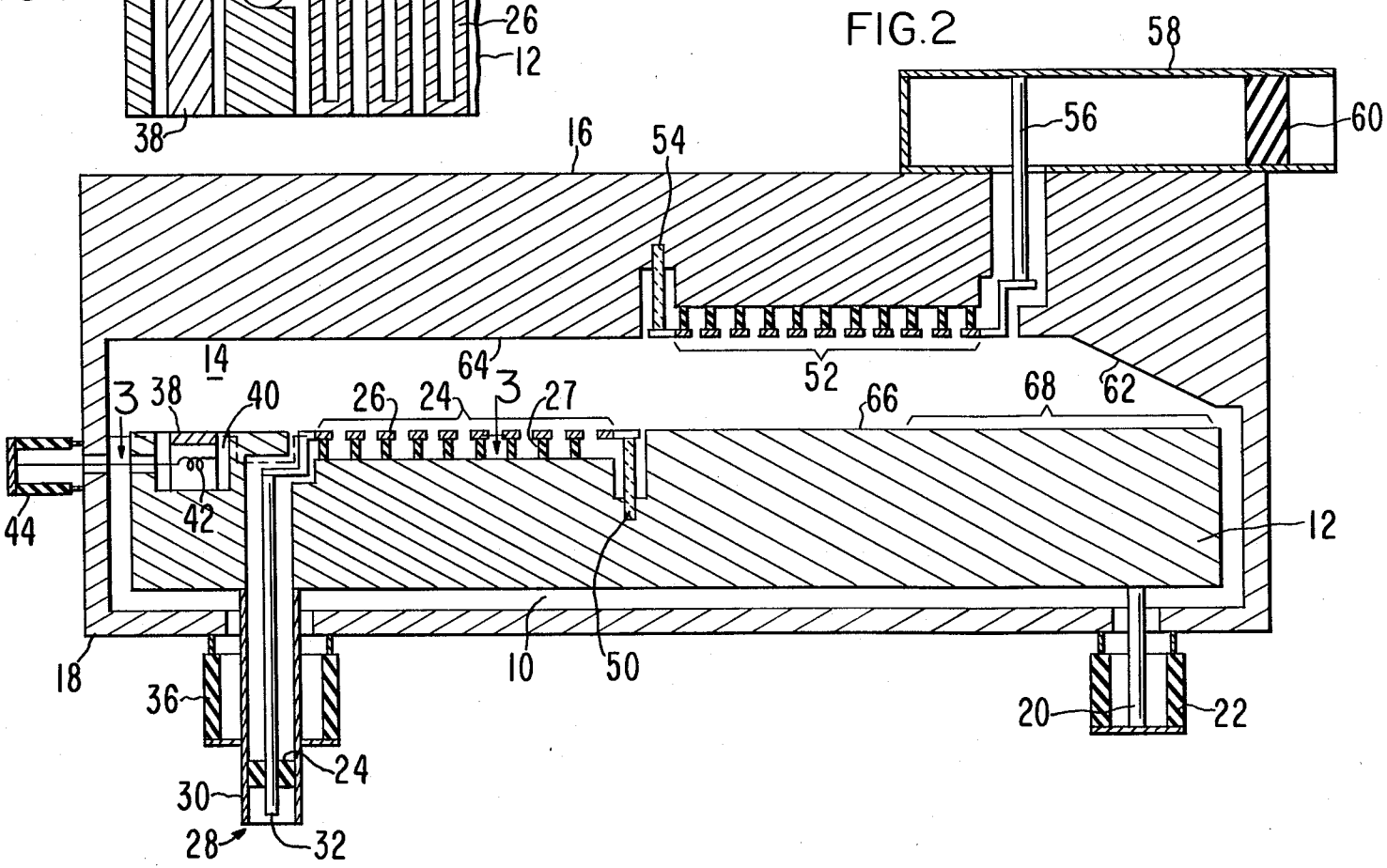
FIG. 2 is a schematic cross-section of a linear CFA embodying the invention.

FIG. 2 illustrates a crossed-field amplifier tube embodying the invention. The parts are structurally and functionally similar to those of FIG. 1, but the tube has a very important distinction. The portion 64 of anode block 16 opposite cathode slow-wave circuit 24 is smooth, so it does not carry waves at any velocity near that of the electron stream or the input circuit 24. The output circuit 52 is removed downstream of input circuit 24 and the surface 66 of cathode block 12 opposite anode circuit 52 is smooth.

The electron stream is modulated by cathode circuit 24. After passing beyond circuit 24 the stream carries the signal as a spatially modulated travelling charge pattern. The beam charge induces an electromagnetic wave in anode circuit 52. This wave is amplified by interaction of circuit 52 and the beam and coupled to the useful load by output waveguide 58.

No wave, forward or backward, on anode circuit 52 can couple energy back to cathode circuit 24 because they are spatially removed and because the electron stream moves only from input to output and cannot carry retrograde modulation. With this inventive improvement, the amplifier is made much more stable and greatly increased gain may be obtained.

On the smooth portion of cathode block 12 before the end of anode circuit 52, part 68 of the surface facing anode block 16 may be formed of a material with low secondary emission yield. Electrons returning to this surface will not be fully replenished through secondary emission multiplication. As a consequence, charge will be drained from the space between electrodes and only a reduced number of electrons will enter the collector region to be collected on the high-potential anode where their bombarding energy is much higher.

Figure 3:
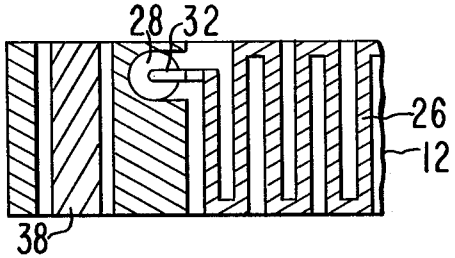
FIG. 3 is a partial horizontal section of the CFA of FIG. 2.

FIG. 3 is a partial section of the CFA of FIG. 2 taken on the horizontal plane 3. It illustrates the form of the meander-line slow-wave circuit formed by the meandering conductor 26. The input coupling via coaxial line 28 attached directly to the end of conductor 26 is also shown.

The described embodiment of the invention is in a non-reentrant CFA. It is intended to be illustrative and not limiting. Many other embodiments will become obvious to those skilled in the art. The crossed-field amplifier may be in a circular form and/or with a recirculating electron stream. In this case a long drift space free of rf waves would follow the output circuit. It could incorporate irregular geometries to "scramble" the electron stream to remove any residual modulation. The meander-line circuits may be replaced by any of the other known slow-wave circuits, for example, coupled individual vanes, helix coupled bars, stub-supported meander lines, etc. The degree of displacement of the anode circuit beyond the end of the cathode circuit may vary, depending on the particular tube design. For moderate gain tubes, the circuits may overlap to some extent. The scope of the invention is to be limited only by the following claims and their legal equivalents.

I claim:

1. A crossed-field amplifier tube comprising:

an extended cathode, at least a section of an interaction surface being part of a wave-transmissive cathode slow-wave circuit, said wave-transmissive portion having a secondary emission ratio greater than unity, means for coupling an input transmission line to an input end of said cathode slow-wave circuit, an extended anode having an interaction surface facing said cathode interaction surface and spaced therefrom, at least a section of said anode interaction surface being part of a wave-transmissive anode slow-wave circuit, at least a portion of said anode slow-wave circuit extending beyond said cathode slow-wave circuit in a direction of drift and at least a portion of said cathode slow-wave circuit extending beyond said anode slow-wave circuit in a direction opposite said drift, means for coupling an output end of said anode slow-wave circuit to an output transmission line, said cathode and anode being adapted for applying a DC electric field between said anode and said cathode and a DC magnetic field parallel to said interaction surfaces and perpendicular to their longitudinal extent, said slow-wave circuits being adapted to transmit waves in the direction of drift of electrons in said DC fields.

2. The tube of claim 1 furtrher comprising means for coupling a wave-absorbing load to the other end of said cathode slow-wave circuit.

3. The tube of claim 1 further comprising means for coupling a wave-absorbing load to the other end of said anode slow-wave circuit.

4. The tube of claim 1 wherein said slow-wave circuits are displaced such that no section of said anode circuit lies opposite said cathode circuit.

5. The tube of claim 1 wherein said cathode interaction surface comprises a section not capable of propagating a slow wave, opposite at least a section of said anode slow-wave circuit.

6. The tube of claim 5 wherein said non-propagating section extends opposite the full length of said anode slow-wave circuit.

7. The tube of claim 5 wherein at least a part of said non-propagating section has a secondary emission ratio greater than unity.

8. The tube of claim 7 wherein said non-propagating section comprises a section of low secondary electron emissivity displaced from said emissive section in said direction of electron drift.

9. The tube of claim 1 wherein said cathode and said anode are separated by an electron-stream passageway, said passageway extending in a closed loop for re-entry of a electron stream, and wherein said cathode interaction surface and said anode interaction circuit have opposed sections beyond the end of said anode interaction surface in said direction of electron drift, on which waves do not propagate with velocities comparable to the velocity of said drift.

10. The tube of claim 1 further comprising a thermionic cathode near the upstream end of said cathode circuit for producing a small priming electron beam current.

* * * * *